United States Patent [19]

Klein

[11] Patent Number: 4,907,566

[45] Date of Patent: Mar. 13, 1990

[54] RETRACTABLE ARROW-SUPPORT DEVICE FOR A BOW

[76] Inventor: Claude Klein, 40, rue Hémet, Aubervilliers (Seine Saint Denis), France

[21] Appl. No.: 349,598

[22] Filed: May 9, 1989

[30] Foreign Application Priority Data

May 11, 1988 [FR] France ..... 88 06375

[51] Int. Cl.[4] ..... F41B 5/00

[52] U.S. Cl. ..... 124/41 A

[58] Field of Search ..... 124/24 R, 41 A, 86, 124/88

[56] References Cited

U.S. PATENT DOCUMENTS 4,170,980 10/1979 Killian ..... 124/41 A
4,344,409 8/1982 Barner ..... 124/24 R
4,592,332 6/1986 Topping ..... 124/41 A
4,732,135 3/1988 Simo ..... 124/41 A
4,809,670 3/1989 Simo ..... 124/41 A

*Primary Examiner*—Randolph A. Reese
*Assistant Examiner*—John A. Ricci
*Attorney, Agent, or Firm*—Hughes & Multer

[57] ABSTRACT

Retractable arrow-support device for a bow, this device being intended to be fixed on the shaft of a bow in the proximity of the area in which the arrow is held at the time of its firing, this device comprising an arrow support movable under the action of a spring and a heavy weight movable in such a way as to be sensitive to the reaction forces produced by the bow upon firing of the arrow, this heavy weight constituting a lock for retaining the arrow support in the active position counter to the spring and for releasing it upon firing of the arrow in order to retract it, the device being characterized in that the arrow support (3, 4) consists of a rod (14) mounted slideably under the action of this spring (15).

14 Claims, 3 Drawing Sheets

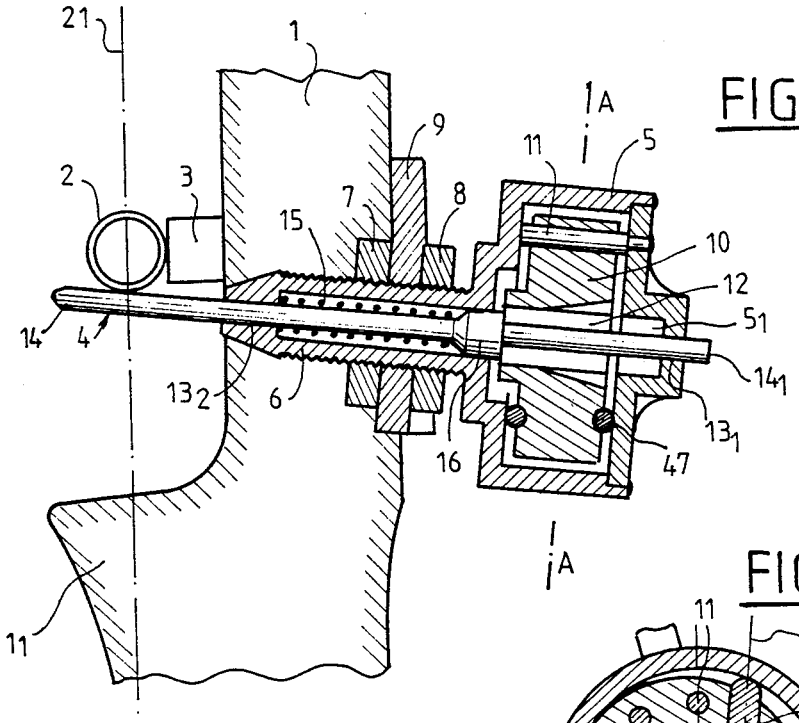
FIG. 1
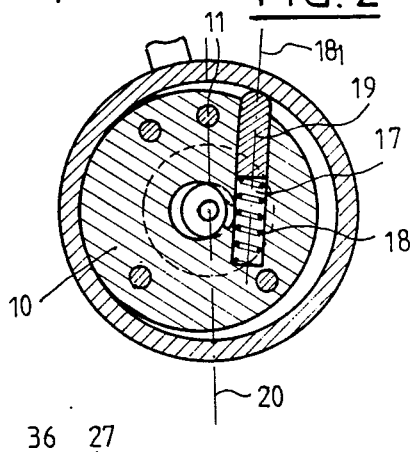
FIG. 2
FIG. 3
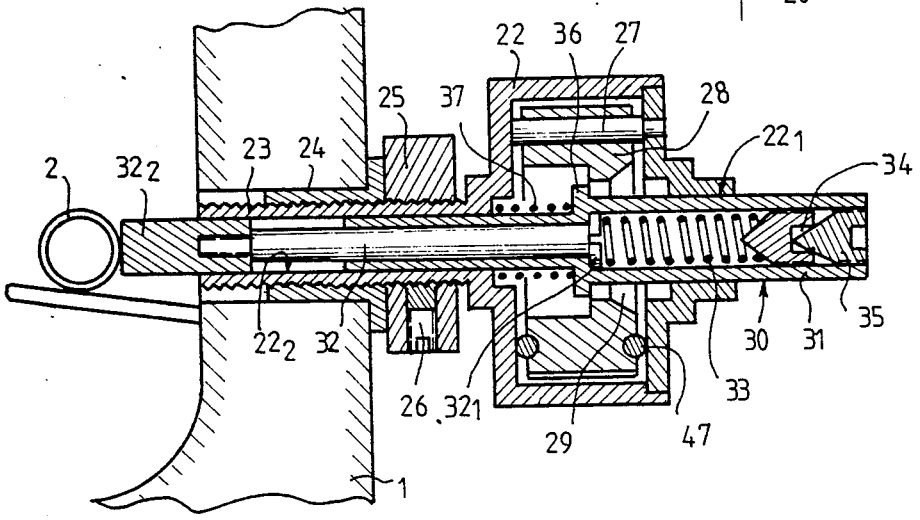

RETRACTABLE ARROW-SUPPORT DEVICE FOR A BOW

The invention relates to a retractable arrow-support device for a bow.

Retractable arrow-rests are already known which are fixed on the shaft of the bow in the proximity of the area in which the arrow is held, in order to support the arrow during aiming, and then to retract as soon as the firer releases the bowstring. These devices prevent the arrow from being deflected from its trajectory, particularly when the feathering of the arrow draws level with the arrow-rest.

These known devices are composed (see, for example, U.S. Pat. No. 4,344,409) of a heavy weight which slides counter to a spring and an arrow-rest mounted pivotably likewise counter to the spring. The heavy weight, sensitive to the reaction forces produced by the bow upon firing of the arrow, constitutes a lock for maintaining the arrow-rest in the active position and, on the other hand, for releasing this arrow-rest upon firing of the arrow, in order to retract it under the action of its spring.

It is of course understood that the release of the arrow-rest must be extremely fast, since it must be effected in a time shorter than the time it takes for the arrow to pass the shaft of the bow. It is now apparent that with the known device hereinabove it is not possible for this result to be achieved in a reliable manner. In addition, it completely lacks sensitivity and is the centre of vibrations which lead to the arrow-rest oscillating upon firing of the arrow.

The aim of the present invention is in particular to overcome these disadvantages and, to this end, it relates to a retractable arrow-support device characterized in that the arrow support consists of a rod sliding under the action of its spring.

According to another characteristic of the invention, the sliding rod and the pivoting axle of the heavy weight are arranged essentially in one and the same plane.

According to another characteristic of the invention, the sliding rod constitutes an arrow-rest and is arranged slightly obliquely relative to the aiming plane of the bow.

According to another characteristic of the invention, the heavy weight is provided with an opening which passes right through it and through which the sliding rod passes with play, the rod being provided with a lateral projection coming to bear, under the action of its spring, against the edge of the opening, the width of the rod at the level of the projection being less than that of the opening.

The invention is shown by way of a non-limiting example on the attached drawings, in which:

FIG. 1 is a diagrammatic cutaway view of an embodiment of the device according to the invention fitted on the shaft of a bow;

FIG. 2 is a cutaway view along A—A in FIG. 1;

FIG. 3 is a diagrammatic axial cutaway view of an arrow spacer fitted on the shaft of a bow;

Figure 4:
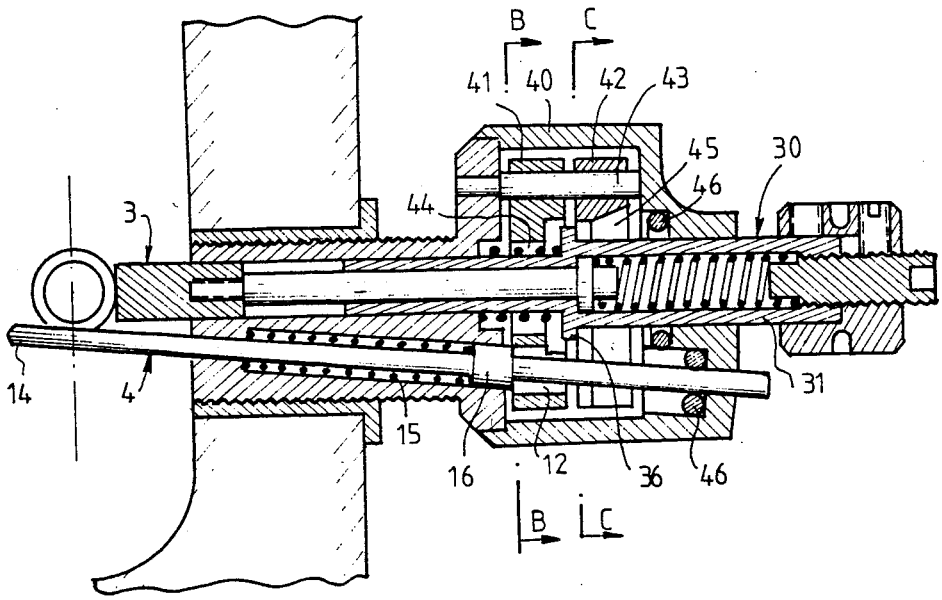
FIG. 4 shows a combined device forming at one and the same time an arrow-rest and arrow spacer.
Figure 5:
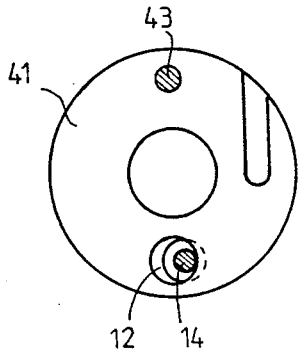
FIGS. 5 and 6 are, respectively, cuts along B—B and C—C of the heavy weights in FIG. 4.
Figure 6:
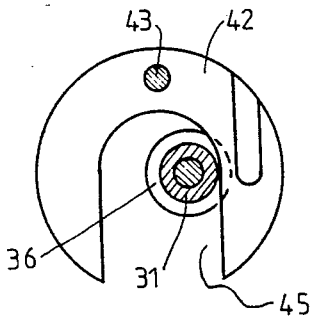

The aim of the present invention is consequently to produce a retractable arrow-support device which is strong, fast and accurate, this device in addition not being the centre of parasitic oscillations capable of interfering with its functioning.

FIG. 1 shows the shaft 1 of a bow, the hand grip of which is situated at $1_1$. This bow receives an arrow 2.

The arrow is positioned on the shaft 1, on the one hand, by an arrow spacer 3 and, on the other hand, by an arrow-rest 4.

This arrow-rest 4 is composed of a hollow casing 5 of general cylindrical form, which is provided with a threaded extension 6 serving for fixing the casing 5 on the shaft 1 by means of a screw 7, a counternut 8 and a support plate 9.

Arranged inside the hollow casing 5 is a heavy weight 10, likewise of general cylindrical form, which is mounted pivotably on an upper axle 11 of the casing, this axle being arranged in a plane passing through the sliding rod. This heavy weight 10 is provided with an opening 12 of general conical form which passes right through it.

The casing 5 is provided, on either side of the heavy weight 10, with two openings $13_1$ and $13_2$ which slideably receive a rod 14. this rod 14 constitutes the actual arrow-rest and passes right through the casing 5 so that, in one of its positions (shown in FIG. 1), the arrow 2 can come to rest on the rod 14. This rod 14 is mounted slideably in the casing 5 under the action of a coil spring 15 which is arranged in the extension 6 around the rod 14. This rod 14 is also provided with a projection 16 fashioned in the form of an annular collar and on which there bears one of the ends of the spring 15. The internal diameter of the spring 16 is less than the diameter of the collar. The collar 16 is of a diameter less than the diameter of the small base of the conical opening 12 and, in the locking position shown in FIG. 1, the axis of the opening 12 is offset relative to that of the rod 14, in such a way that the collar 16 comes to bear against one of the faces of the heavy weight 10 at the edge of the opening 12.

The heavy weight 10 also comprises a bore 17 (see FIG. 2) inside which there is mounted a coil spring 18 forcing back a finger 19. This finger moreover bears against the inside wall of the hollow casing 5. This spring, whose axis $18_1$ is situated essentially parallel to the plane 20 containing the pivoting axle 11 and the sliding rod 14, maintains the heavy weight 10 bearing laterally against the inside wall of the hollow casing 5.

Upon firing of the arrow 2, the reaction forces created on the shaft of the bow by the string of this bow produce the pivoting of the heavy weight 10 about the axle 11 counter to the spring 18. The effect of this is to position the conical opening 11 in alignment with the collar 16 in such a way that the spring 15 suddenly forces the rod 14 back until this projection 16 comes to bear in an opposite seat $5_1$ of the casing 5. In this position, the rod 14 is completely retracted inside the extension 6 and the arrow can continue its trajectory without risk of being deflected by its feathering coming into contact with this rod 14.

In order to effect the reloading of this arrowrest, it suffices to exert a pressure on the end $14_1$, the effect of this being to pivot the heavy weight 10 counter to the spring 18, as a result of the sliding of the projection 16 against the conical wall of the opening 12. This movement continues until the projection 16 assumes a position beyond the heavy weight 10. At this moment, the spring 18 returns the heavy weight 10 to the position shown in FIG. 2, and it is then possible to relax the pressure exerted on the rod 14, in such a way that the collar 16 comes to bear once again on the lateral face of the heavy weight 10.

As indicated in FIG. 1, the casing 5 is fixed by means of its extension 6 on the shaft 1 of the bow, in such a way that the sliding rod 14 is slightly inclined relative to the aiming plane 21. The effect of this arrangement is to improve the support of the arrow on the sliding rod 14, tending to make it slide towards the spacer 3 in order to prevent it falling from the sliding rod.

In FIG. 3 an arrow support has been shown which is also produced on the same construction principle but which in this case constitutes an arrow spacer, also called "button shepherd".

In this case the cylindrical casing 22 is provided with an extension 23 via which it is fixed, to the shaft 1 of the bow, by means of a threaded ring 24 and a blocking piece 25 with a binding screw 26.

The casing 22 comprises a pivoting axle 27 for a pivoting weight 28. This weight is provided with an opening 29 through which passes a rod 30 mounted slideably on either side of the heavy weight 28 in orifices $22_1$ and $22_2$ of the casing.

The rod 30 is made in two parts, 31 and 32, sliding coaxially with respect to each other, counter to an absorbing spring 33 which constantly tends to maintain the end $32_1$ of the internal part 32 against an internal projection of the external part 33.

The pressure force of this spring 33 can be controlled by a first screw 34 blocked by a second screw 35.

The part 32 of the rod is provided, at its free end, with a piece $32_2$ on the end of which there bears the arrow 2, in order to hold it spaced from the shaft of the bow 1.

The part 31 of the sliding rod 30 is provided with an external circular collar 36 whose diameter is slightly less than that of the truncated opening 29 of the heavy weight 28.

This collar 36 moreover serves as a bearing for a coil spring 37 arranged coaxially outside the part 31, so that this spring 37 constantly tends to maintain the projection 36 against the edge of the truncated opening 29.

The functioning of this device is as follows.

When an arrow is fired, the sudden acceleration to which it is subjected results in a slight curving of the shaft of the arrow, which could result in a deviation in its trajectory. However, this deviation is prevented by the arrow spacer according to the invention, since the part 32 of the rod 30 slides counter to the absorbing spring 33 in order to take into consideration the flexion of the arrow support, thus avoiding a deviation in its trajectory. Simultaneously to this absorbing, the reaction forces created when the string is let go result in a pivoting of the heavy weight 28 until the collar 36 slips away from the edge of the heavy weight 28. The spring 37 then suddenly drives back the assembly of the rod 30, retracting the end $32_2$ inside the extension 23.

The arrow spacer is returned to the active position in the same way as for the arrow-rest, by pushing the rod 30 back counter to the spring 37 until the collar 36 comes to bear against the edge of the opening 29 of the heavy weight 28.

In the exemplary embodiment in FIG. 4, an arrow support device has been shown which comprises, in combination, the arrow-rest 4 and the arrow-spacer 3. In this case the casing 40 contains two heavy weights 41 and 42 which pivot on one and the same axle 43 and of which one 41 constitutes the lock for the sliding rod 14 of the arrow-rest 4, and the other 42 the locking means for the sliding rod 30 of the arrow spacer 3.

The heavy weight 41 is provided with a conical opening 12 whose edge forms the locking abutment for the collar 16. This heavy weight 41 also comprises a second opening 44 which forms a passage for the external part 31 of the sliding rod 30. This opening 44 is of dimensions which are sufficient to ensure that the heavy weight 41 never comes into contact with this part 31, whatever its angular position. In contrast, the heavy weight 42 comprises an opening 45 against the edge of which the collar 36 bears when the arrow spacer 3 is in the active position. This opening 45 extends as far as the periphery of the heavy weight 42 in order to likewise permit the passage of the sliding rod 14, without however affecting the clearance of this rod.

O-rings of self-lubricating material 46 can be provided around the sliding rods 30 and 14 in order to perfect their guidance.

Equally, the lateral guidance of the heavy weights 10, 28, 41 and 42 can be improved by providing roller balls 47 (see FIGS. 1 and 3).

In all these embodiments, the force of the springs will be preferably adjustable, in order to adapt it to the reaction force produced, this reaction force itself being a function of the power of the bow.

Figure 7:
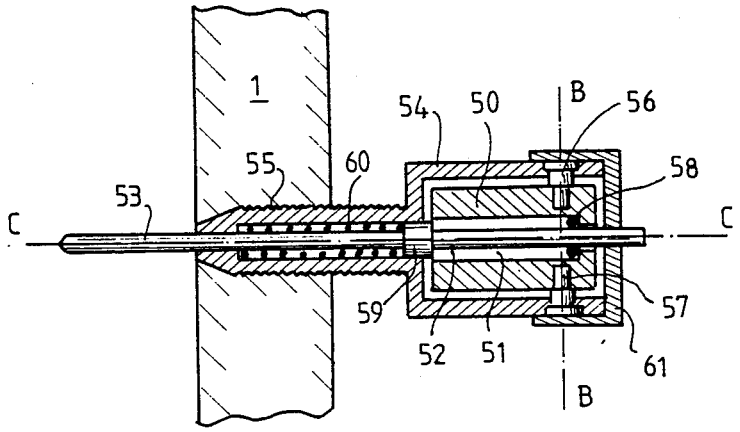
FIG. 7 is an axial cutaway view of another embodiment of the device.
Figure 8:
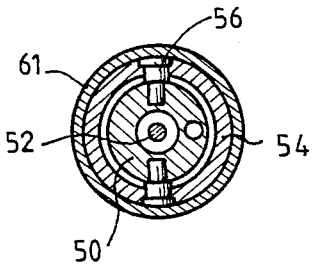
FIG. 8 is a cut along B—B in FIG. 7.
Figure 9:
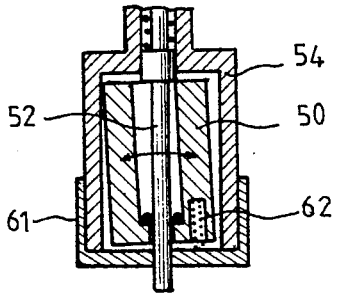
FIG. 9 is a partial cut along C—C in FIG. 7.

Also, according to the embodiments in FIGS. 1 to 6, the heavy weight is mounted pivotably. In contrast, according to the embodiment in FIGS. 7 to 9, the heavy weight is mounted pivotably along an axis perpendicular to the sliding rod. Thus, in this case, the heavy weight 50 is produced in the form of a cylinder of circular cross-section and is provided with an axial orifice serving as a passage for the sliding rod 52 whose end 53 forms the arrow-rest. The heavy weight 50 is mounted pivotably in the vicinity of one of its ends on the axle portions 57 formed at the end of screws 56 screwed into the wall of the casing 54 in such a way that these axle portions 57 are oriented perpendicular to the rod 52. The axial orifice 51 is provided with an end $51_1$ of narrowed cross-section, against which an O-ring 58 bears. This narrowed part $51_1$ is intended to constitute an abutment for the lateral projection 59 of the sliding rod 52 on which the helical spring 60 acts.

The casing 54 is closed by a cover 61 against which there bears one of the ends of a spring 62 accommodated in a hole in the end of the heavy weight 50.

The functioning of this device is similar to that of the embodiment in FIGS. 1 to 6. Thus, when the bowstring is let go, the reaction forces created product the pivoting of the weight 50 around the axle portions 57 until the orifice 51 takes up a position coaxial to the projection 59. At this moment the spring 60 causes the rod 52 to suddenly slide, so that its arrow-rest end 53 is retracted inside the threaded extension 55 of the casing 54.

The reloading of the arrow-rest is effected by the reverse manoeuvre, by bearing on the rear end of the sliding rod 52 counter to the spring 60.

What is claimed is:

1. Retractable arrow-support device for a bow, this device being intended to be fixed on the shaft of a bow in the proximity of the area in which the arrow is held during its firing, this device comprising an arrow support movable under the action of a spring and a heavy weight movable in such a way as to be sensitive to the reaction forces produced by the bow upon firing of the arrow, this heavy weight constituting a lock for retaining the arrow support in the active position counter to the spring and for releasing it upon firing of the arrow in order to retract it, the device being characterized in that the arrow support (3, 4) consists of a rod (14, 30) mounted slideably under the action of this spring (15, 37).

2. Device according to claim 1, characterized in that there is a sliding rod and a pivoting axle (11, 27) of the heavy weight (10, 28) arranged essentially in one and the same plane.

3. Device according to claim 2, characterized in that the pivoting axle is parallel to the sliding rod.

4. Device according to claim 3, characterized in that the sliding rod (14) constitutes an arrow-rest and is arranged slightly obliquely relative to the aiming plane (21) of the bow.

5. Device according to claim 1, characterized in that the heavy weight is provided with an opening (12, 29) which passes right through it and through which a sliding rod passes with play, the rod being provided with a lateral projection (16, 360 coming to bear, under the action of its spring (15, 37), against the edge of the opening in question, the width of the projection being less than that of the opening.

6. Device according to claim 5, characterized in that the spring (15, 37) of the sliding rod (1) is a coil spring arranged coaxially to the rod and of which the external diameter is less than the width of the projection (16, 36).

7. Device according to claim 5, characterized in that the opening (12, 29) is flared, its smallest cross-section being situated at its end against whose edge the projection bears.

8. Device according to claim 1, characterized in that the heavy weight is arranged inside a casing (5, 22) provided with two orifices ($13_1$, $13_2$, $22_1$, $22_2$) arranged on either side of the heavy weight, these orifices slideably receiving the sliding rod which passes right through the casing.

9. Device according to claim 1, characterized in that a return spring (18) is provided to cooperate with the heavy weight, this spring being oriented in a direction ($18_1$) approximately parallel to the plane (20) containing the pivoting axle (11, 27) and the sliding rod (14, 30).

10. Device according to claim 1, characterized in that the sliding rod (30) constitutes an arrow spacer and is made in two parts (31, 32) one sliding in the other counter to an absorbing spring (33).

11. Device according to claim 1, characterized in that there is a casing (40) which contains two heavy weights (41, 42) mounted pivotably on one and the same axle (43) and two sliding rods (14, 30) which pass right through them, one of these rods constituting an arrow-rest, the other an arrow spacer.

12. Device according to claim 11, characterized in that the two heavy weights are both provided with openings ensuring the passage of the two sliding rods with play, one end of one opening of each of the weights forming a retaining lock for one of the rods.

13. Device according to claim 1, characterized in that the sliding rod and the pivoting axle of the heavy weight are essentially perpendicular.

14. Device according to claim 13, characterized in that the heavy weight is produced in the form of a cylinder provided with an axial passage through which the sliding rod passes, the pivoting axle being situated transversely in the proximity of one end of the cylinder.

* * * * *